US012753663B2

(12) United States Patent
Smith et al.

(10) Patent No.: US 12,753,663 B2
(45) Date of Patent: Oct. 6, 2026

(54) ROD HANDLING SYSTEM FOR A DRILLING RIG

(71) Applicant: Tribe Technology Group Limited, Belfast (GB)

(72) Inventors: Ivan Smith, Mallusk (GB); Sirish Gorijala, Shelley (AU); James Charles Osborne King, Mallusk (GB); Lee Scott, Willerby (GB)

(73) Assignee: Tribe Tech UK Ltd, Covent Garden (GB)

( * ) Notice: Subject to any disclaimer, the term of this patent is extended or adjusted under 35 U.S.C. 154(b) by 18 days.

(21) Appl. No.: 18/870,942

(22) PCT Filed: May 22, 2023

(86) PCT No.: PCT/EP2023/063561
§ 371 (c)(1),
(2) Date: Dec. 2, 2024

(87) PCT Pub. No.: WO2023/232511
PCT Pub. Date: Dec. 7, 2023

(65) Prior Publication Data

US 2025/0347183 A1 Nov. 13, 2025

(30) Foreign Application Priority Data

May 31, 2022 (GB) ..... 2208007

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/00; E21B 19/14; E21B 19/15; E21B 19/155; E21B 19/16; E21B 19/165; E21B 19/18; E21B 19/20
See application file for complete search history.

(56) References Cited

U.S. PATENT DOCUMENTS 3,844,420 A 10/1974 Walling et al.
7,600,584 B2 * 10/2009 Sewell ..... E21B 7/046 166/85.1

(Continued)

FOREIGN PATENT DOCUMENTS

| | | |
|---|---|---|
| EP | 1746247 | 1/2007 |
| GB | 1308216 | 2/1973 |
| WO | 9810986 | 3/1998 |

OTHER PUBLICATIONS

UK Search Report of corresponding Application No. GB2208007.1 date of search: Oct. 15, 2022.

(Continued)

*Primary Examiner* — Lynn E Schwenning
(74) *Attorney, Agent, or Firm* — Gardner, Linn, Burkhart & Ondersma LLP

(57) ABSTRACT

A rod handling system for a drilling rig includes a rod storage bin incorporating vertically stacked rod supports adapted to hold a respective row of rods in side by side relationship in a substantially horizontally extending storage configuration. A rod loader having a plurality of rod holders is moveable between a loading position in which a rod can be placed into or removed from each rod holder, and a transfer position in which the rods are transferable between each rod holder and a respective rod support of the rod storage bin A rod lifter is moveable between a lowered position and a raised position for lifting rods between the storage configuration and a raised configuration to present rods to a drilling head. A rod transfer assembly can transfer (Continued)

individual rods between selected rod supports of the rod storage bin and the rod lifter.

28 Claims, 20 Drawing Sheets

(56) References Cited

U.S. PATENT DOCUMENTS

| | | | | |
|---|---|---|---|---|
| 10,808,466 | B2 * | 10/2020 | Porter | E21B 19/20 |
| 2003/0170095 | A1 * | 9/2003 | Slettedal | E21B 19/155<br>414/22.59 |
| 2005/0263662 | A1 * | 12/2005 | Skaley | F16L 3/223<br>248/292.13 |
| 2007/0092358 | A1 * | 4/2007 | Innes | E21B 7/02<br>414/22.51 |
| 2007/0119623 | A1 | 5/2007 | Sewell et al. | |
| 2022/0003054 | A1 | 1/2022 | Mikalsen et al. | |

OTHER PUBLICATIONS

International Search Report of the International Searching Authority from corresponding Patent Cooperation Treaty (PCT) Application No. PCT/EP2023/063561, mailed Aug. 29, 2022.

* cited by examiner

ROD HANDLING SYSTEM FOR A DRILLING RIG

CROSS REFERENCE TO RELATED APPLICATIONS

This present application is a § 371 national stage of International Application PCT/EP2023/063561, filed May 22, 2023, which claims priority benefit of U.K. Pat. Application Ser. No. 2208007.1, filed May 31, 2022, both of which are hereby incorporated herein by reference in their entireties.

FIELD OF THE INVENTION

This invention relates to a rod handling system for a drilling rig and in particular to a rod handling system for a mineral exploration drilling rig.

BACKGROUND OF THE INVENTION

Exploration drilling is an important step in establishing new mining operations for the recovery of valuable minerals. Exploration drilling is essential for obtaining temperature measurements, rock samples, and retrieving fluid samples for chemical analysis. Exploration drilling is also used in the mining industry to probe the contents of known ore deposits and potential sites. By withdrawing samples of rock and soil at from specific depths, geologists can analyse the samples by chemical assay and conduct petrologic, structural, and mineralogical studies of the underground structures.

Mineral exploration is carried out extensively in the harsh conditions of the Australian outback to identify underground mineral resources to establish new mining operations. Drilling provides most of the information for the final evaluation of a prospect and will determine if the prospect is mineable. Drilling is used to search for mineral occurrences or clues in the rocks that may lead to mineral deposits. The information gathered during this stage may or may not lead to a discovery of valuable minerals. Drilling penetrates deep into the ground and brings up samples of whatever it finds on its way. If there is any mineralisation at given points far beneath the surface, drilling can quantify its presence at that particular point.

However, existing exploration drilling rigs require skilled operators, often working in difficult and hazardous conditions. Exploration drilling rigs are frequently used in remote areas of difficult terrain and harsh weather conditions. Drilling in any environment is potentially hazardous but mineral exploration in remote locations, such as those encountered in Western Australia, presents additional risk factors. Therefore, there is a desire to move towards autonomous exploration drilling rigs requiring less direct manual intervention during operation.

Mineral Exploration drill rigs can be set up for reverse-circulation drilling, rotary air blast drilling, wireline coring or open-hole boring. In reverse-circulation (RC) drilling, drill rods having two concentric tubes are used. Compressed air is supplied through the gap between the inner and outer tubes to act on a pneumatic reciprocating piston, known as a downhole hammer, including a drill bit with round protruding tungsten-carbide buttons that can cut hard rock. Drill cuttings are returned to the surface via the inner tube inside the drill rods. The drill rods used for RC drilling are typically 6 m long and weigh about 200 kg. For deeper drilling, a collar (PVC or metal piping) may be installed at the surface to prevent unconsolidated material collapsing into the hole. Collars may extend to 30 m depth depending on the stability of the surface formations. Circulation is achieved by pumping air between the outer and inner tubes of the drill rods, with the air returning up the inner tube and lifting cuttings to the surface. At the surface, the cuttings are typically directed through a hose into a cyclone for collection and bagging.

RC drilling rigs are usually accompanied by support vehicles for supplying drill rods to the drilling rig. Typically, a manually operated loading arm is used to pick a rod from a storage rack or bin, lift it and add it to the drill string, aligning it with the rotary head and the mast. Therefore, the manual handling of drill rods can be a particularly labour intensive and hazardous process.

It is an object of the present invention to provide a rod handling system for an exploration drilling rig that can be integrated into the drilling rig and which can be autonomously operated without requiring direct operator intervention.

SUMMARY OF THE INVENTION

According to the present disclosure there is provided a rod handling system for a drilling rig including a rod storage bin having an elongate axis and incorporating a plurality of vertically stacked rod supports, each rod support being adapted to hold a respective row of rods in side by side relationship in a substantially horizontally extending storage configuration wherein the rods are aligned with the elongate axis; a rod loader having a plurality of rod holders adapted to carry a plurality of rods in side by side relationship aligned with the elongate axis, the rod loader being moveable between a loading position, wherein a rod can be placed into or removed from each rod holder, and a transfer position, wherein rods are able to be transferred between each rod holder and a respective rod support of the rod storage bin; a rod lifter moveable between a lowered position and a raised position whereby the rod lifter is adapted to lift rods between the substantially horizontally extending storage configuration and a raised configuration to present rods to a drilling head; and a rod transfer assembly adapted to transfer individual rods between selected rod supports of the rod storage bin and the rod lifter.

In one embodiment the rod loader is located on a first side of the rod storage bin, the rod lifter and rod transfer assembly being located on a second side of the rod storage bin, opposite the first side. The rod loader may be mounted for pivotal movement about a horizontal pivot axis parallel to the elongate axis for movement between the loading position, wherein the road loader extends outwardly from the first side of the rod storage bin with the rod holders facing upwardly to allow rods to be place therein, and the transfer position, wherein the rod loader extends vertically adjacent the first side of the rod storage bin. Advantageously the rod loader may close the first side of the rod storage bin when in its transfer position.

Each rod holder of the road loader may be defined by one or more spaced pairs of laterally extending divider plates between which a respective rod may be located.

Optionally, the distance between adjacent pairs of divider plates is adjustable so that the rod holders can carry rods of different diameters or types (e.g. casings or rods).

Rods may be retained in the rod holders of the rod loader by opposing clamp bars provided at opposite ends of the rod loader and moveable towards and away from one another between a clamping position, wherein the clamp bars engage opposite ends of rods located in the rod holders, and a release position, wherein the clamp bars are spaced from the ends of the rods. The clamp bars may be pivotally or linearly moveable between the clamping and release positions. The clamp bars may incorporate pressure testing ports coupled to a pressure testing apparatus to enable the rods to be pressure tested when held in the rod loader.

The rod loader may include pushers adapted to move into each rod holder, when activated and when the rod loader is in its transfer position, to push a rod located therein out of the rod holders and into adjacent rod supports of the rod storage bin.

In one embodiment each rod support of the rod storage bin may include a pair of support members extending inwardly from opposite ends of the rod storage bin and upon which respective ends of the respective rods are supported. Each pair of support members may extend transverse to the elongate axis to support a plurality of rods thereon in side by side relationship in a row. Rods may be retained on the support members of each rod support of the rod storage bin by means of retaining pins provided at each end of each rod support on or adjacent each support member, each retaining pin being moveable between a retracted position, wherein rods are free to pass laterally into and out of the respective rod support, and an extended position, wherein retaining pins interacts with end regions of the rods in each rod support to prevent the rods from passing laterally out of the respective rod support. One or more of the retaining pins may be moveable between the retracted and extended positions axially and in a direction parallel to the elongate axis and/or pivotally between the retracted and extended positions. At least one of the retaining pins at each end of each rod support may be adapted to enter into the path of a respective rod supported therein, such as at or adjacent one end of each support member. At least one of the retaining pins at each end of each rod support may be adapted to enter into a respective end of a respective rod supported therein, such as at or adjacent a central region of each support member.

Each support member of the rod supports may include an L shaped plate extending substantially horizontally and transverse to the elongate axis and inwardly from a respective end of the road storage bin. Each pair of support members of each rod support may be inclined to the horizontal to roll the rods supported thereon to one side or another of the rod storage bin under gravity and may be adjustable to adjust the angle of inclination thereof.

The rod lifter may be pivotally mounted for movement between the lowered and raised positions about a pivot axis extending perpendicular to the elongate axis and located at one end of the rod storage bin, such that the rod lifter moves in an arc through a vertical plane. The rod transfer assembly may include at least one rod carrier for carrying a selected rod, the at least one rod carrier being vertically moveable with respect to the rod storage bin. In one embodiment the at least one rod carrier may move in the vertical plane of the rod lifter while the rod lifter is in its raised configuration, the rod carrier moving laterally out of the vertical plane of the rod lifter when in its uppermost position to allow the rod lifter to move to its lowered position. The transfer assembly may further include a pair of rod cradles being vertically moveable with respect to the rod storage bin to facilitate transfer of rods between a selected rod support and the rod transfer assembly. The rod cradles may include tiltable V shaped upwardly facing support members moveable between an upright rod holding position and at least one tilted rod transfer position, wherein the rod cradles are adapted to transfer rods between the transfer assembly and selected rod supports of the rod storage bin.

Rods may be transferred between the rod carrier and the rod cradles by vertically displacing one with respect to the other.

The rod carrier may be adapted to transfer rods to the rod lifter, when the rod lifter is in its lowered position, by lowering the rod carrier past the rod lifter such that a rod carried by the rod lifter is passed onto rod support members of the rod lifter.

Rod clamps may be associated with the rod supports of the rod lifting to clamp a rod against the rod supports such that the rod can be retained on the rod lifter as it moves to its raised position.

The rod handling system may be mounted on a self-propelled mobile chassis. The chassis may be supported on tracks and may include a drive device for driving the tracks.

The system is adapted to be remotely and/or autonomously controlled.

The system may include a controller programmed to at least semi-autonomously control the operation of the system.

These and other objects, advantages, purposes and features of the present invention will become apparent upon review of the following specification in conjunction with the drawings

BRIEF DESCRIPTION OF THE DRAWINGS

A drilling rig incorporating a rod handling system in accordance with an embodiment of the present invention will now be described, by way of example only, with reference to the accompanying drawings, in which.

DETAILED DESCRIPTION OF THE DRAWINGS

Figure 1:
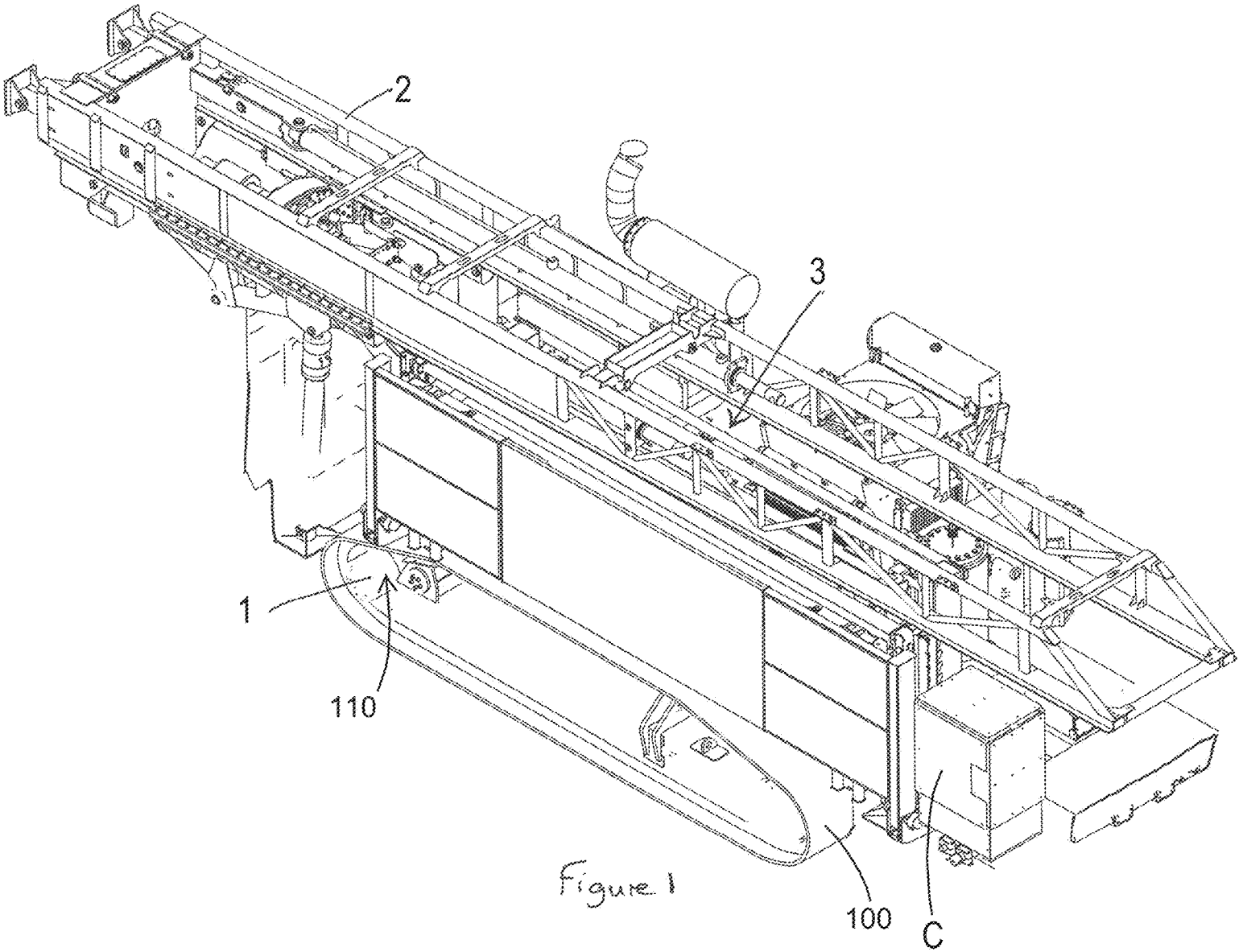
FIG. 1 is a perspective view of a drilling rig incorporating a rod handling system in accordance with an embodiment of the present invention.
Figure 2:
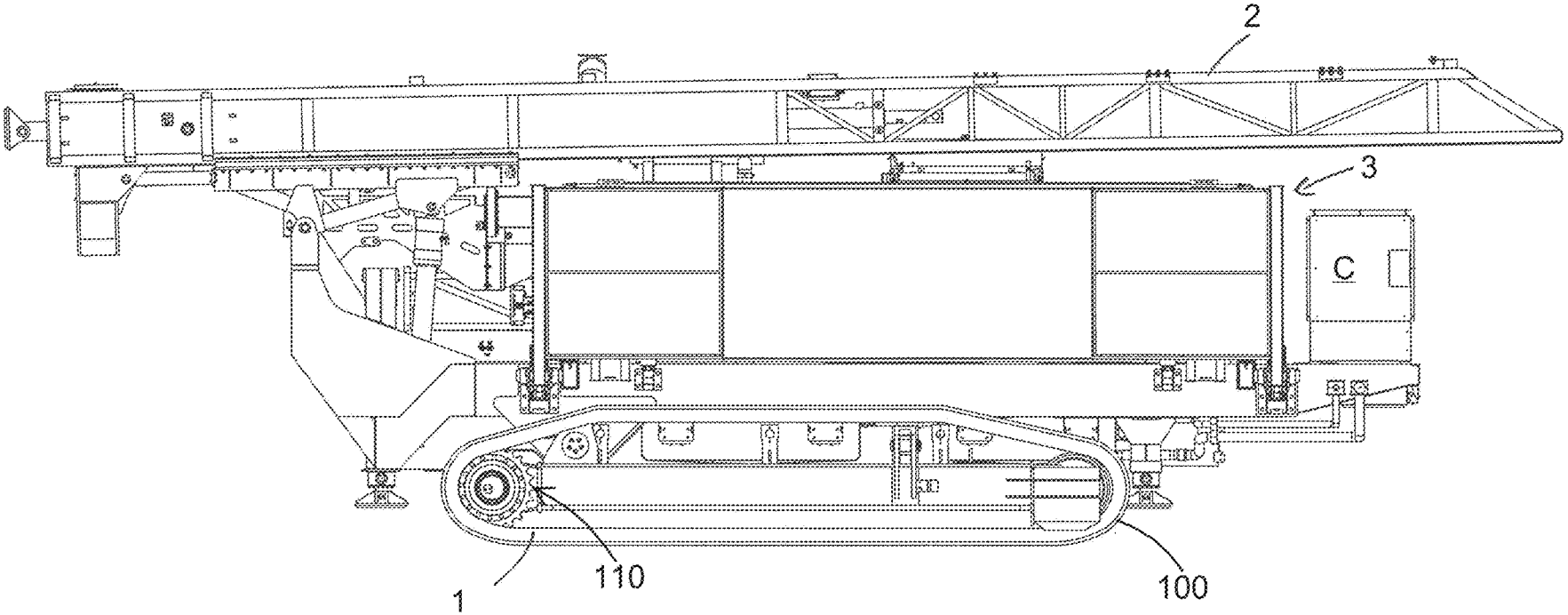
FIG. 2 is a side view of the drilling rig of FIG. 1.
Figure 3:
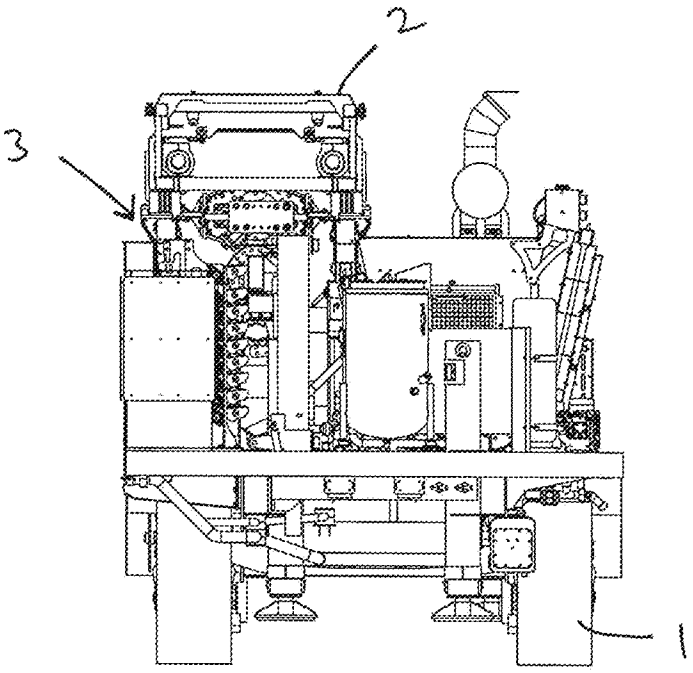
FIG. 3 is an end view of the drilling rig of FIG. 1.
Figure 4:
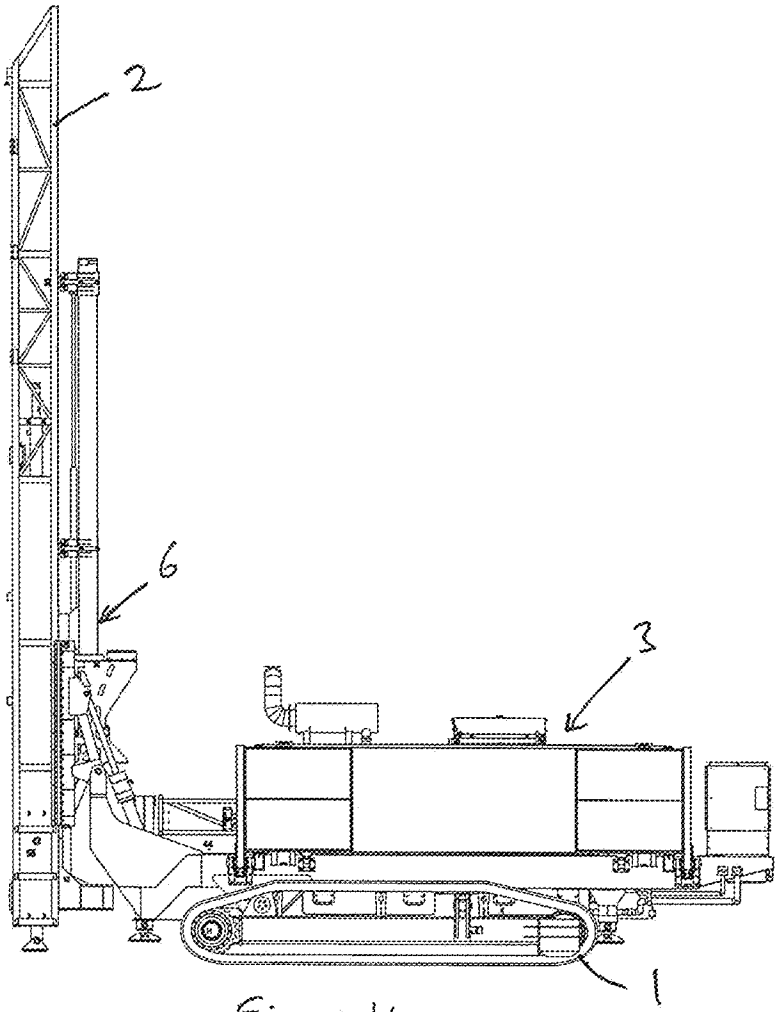
FIG. 4 is a side view of the drilling rig of FIG. 1 with the mast in an upright configuration.

As shown in FIGS. 1 to 4, a drilling rig incorporating a rod handling system includes a self-propelled chassis 1 having tracks 100 and a drive 110 for driving the tracks 100, and a longitudinal axis aligned with a normal direction of travel and upon which is mounted a drilling mast 2, pivotally mounted at one end of the chassis 1 for movement between a substantially horizontal transport position, as shown in FIGS. 1 to 3, and an upright drilling position, as shown in FIG. 4, about a pivot axis extending perpendicular to the longitudinal axis of the chassis.

Figure 5:
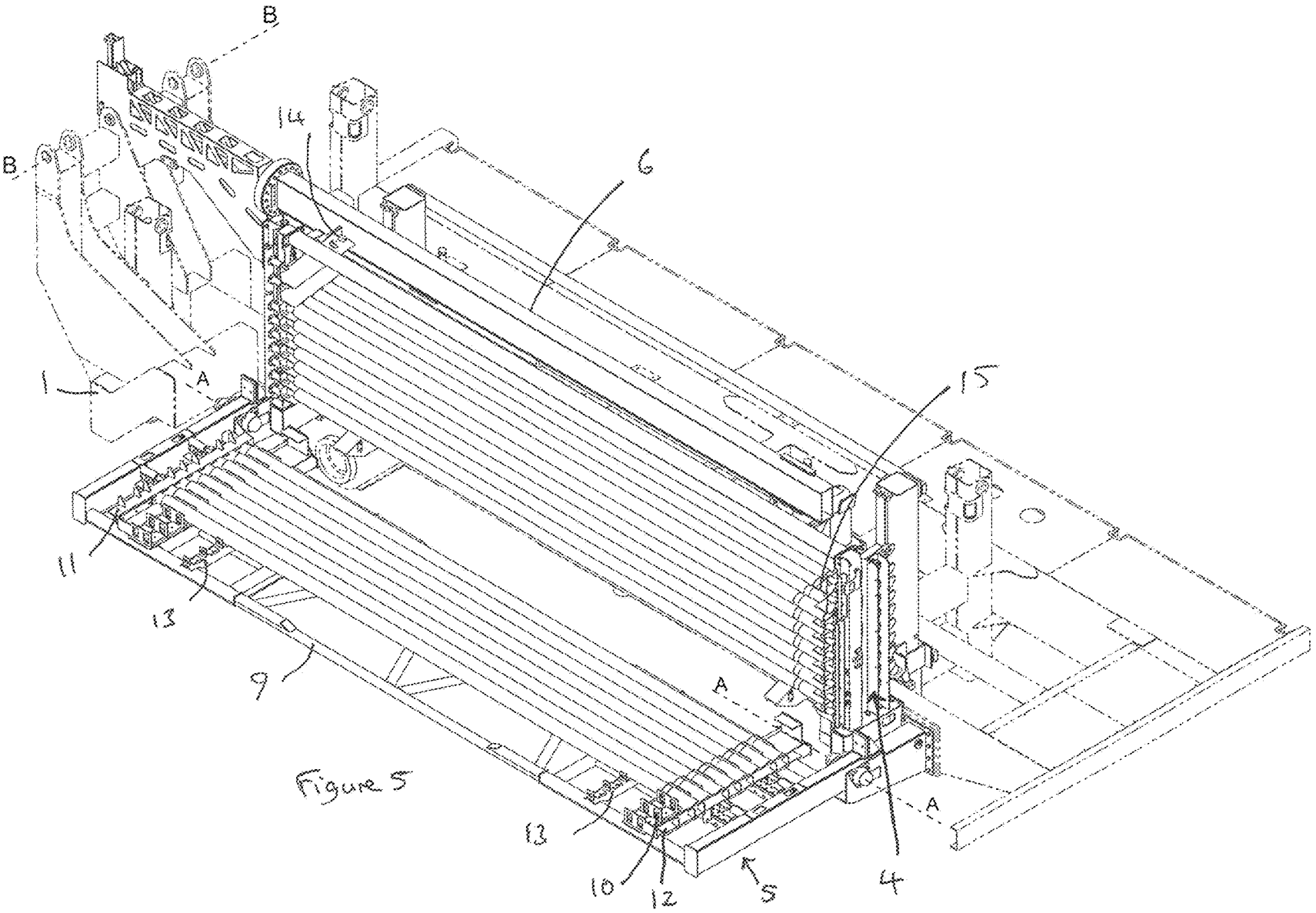
FIG. 5 is a detailed perspective view of the rod handling system of the drilling rig of FIG. 1 with the rod loader in a loading position.
Figure 9:
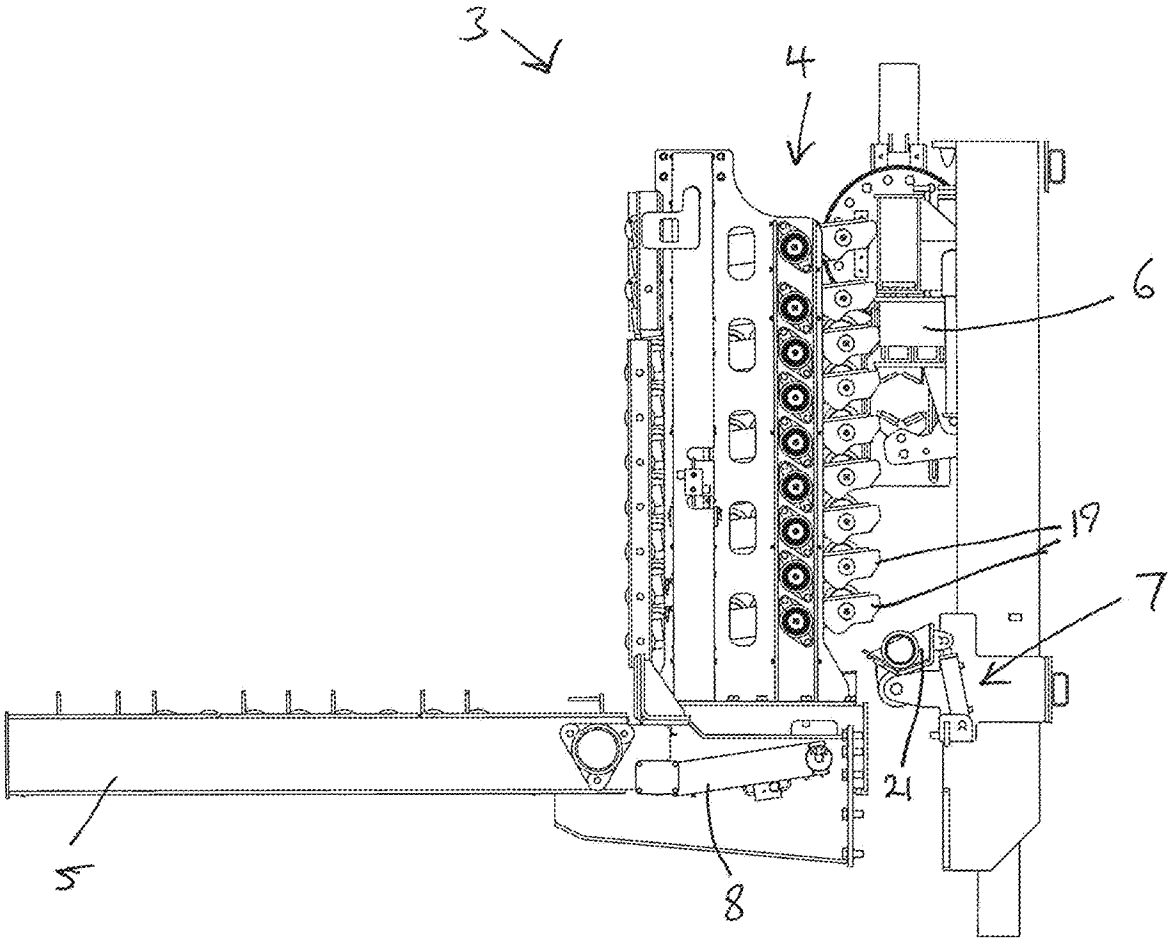
FIG. 9 is a detailed end view of the rod handling system of the drilling rig of FIG. 1 with parts omitted for clarity.
Figure 10:
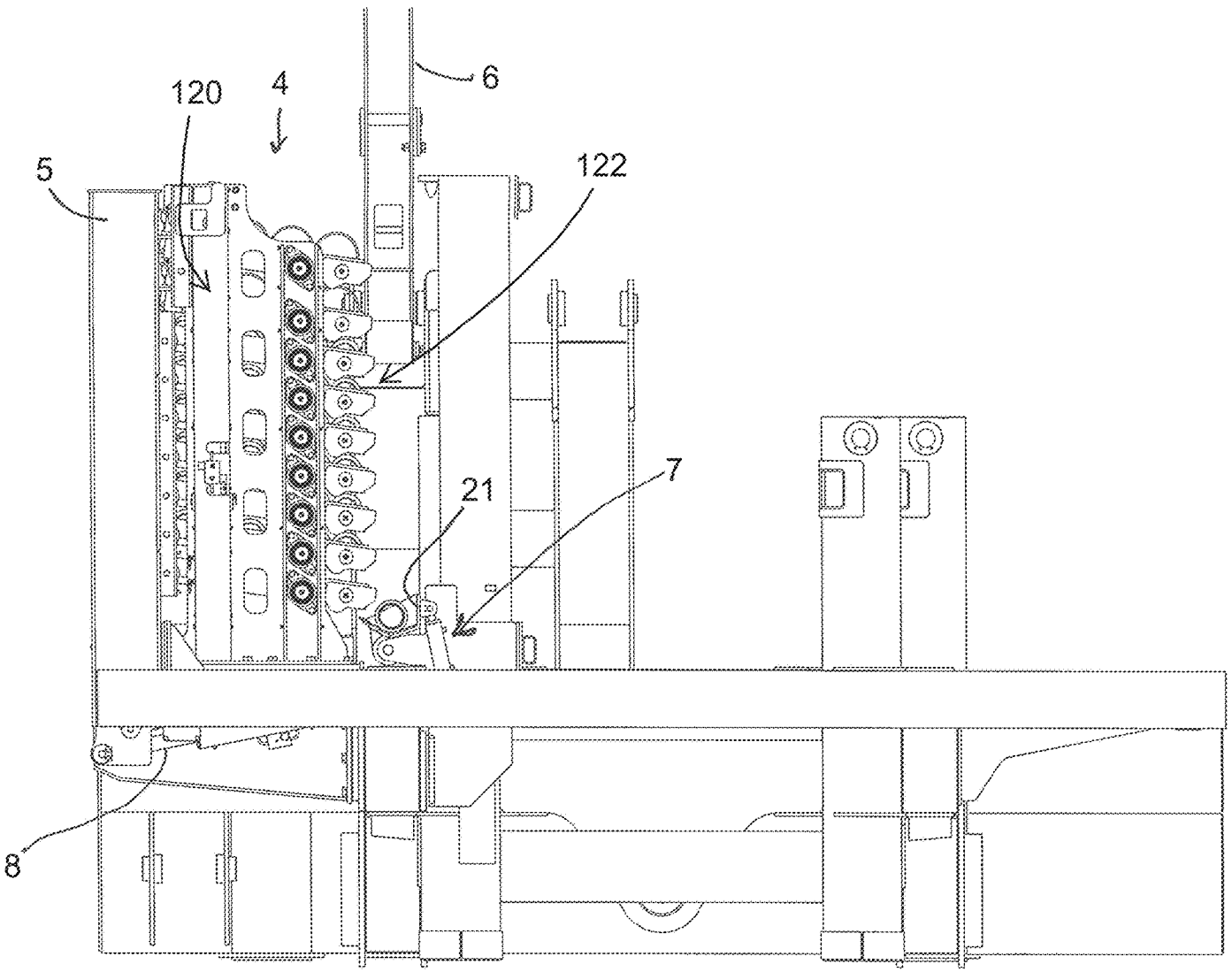
FIGS. 10 to 16 illustrate the operation of the rod handling system of the drilling rig of FIG. 1.
Figure 11:
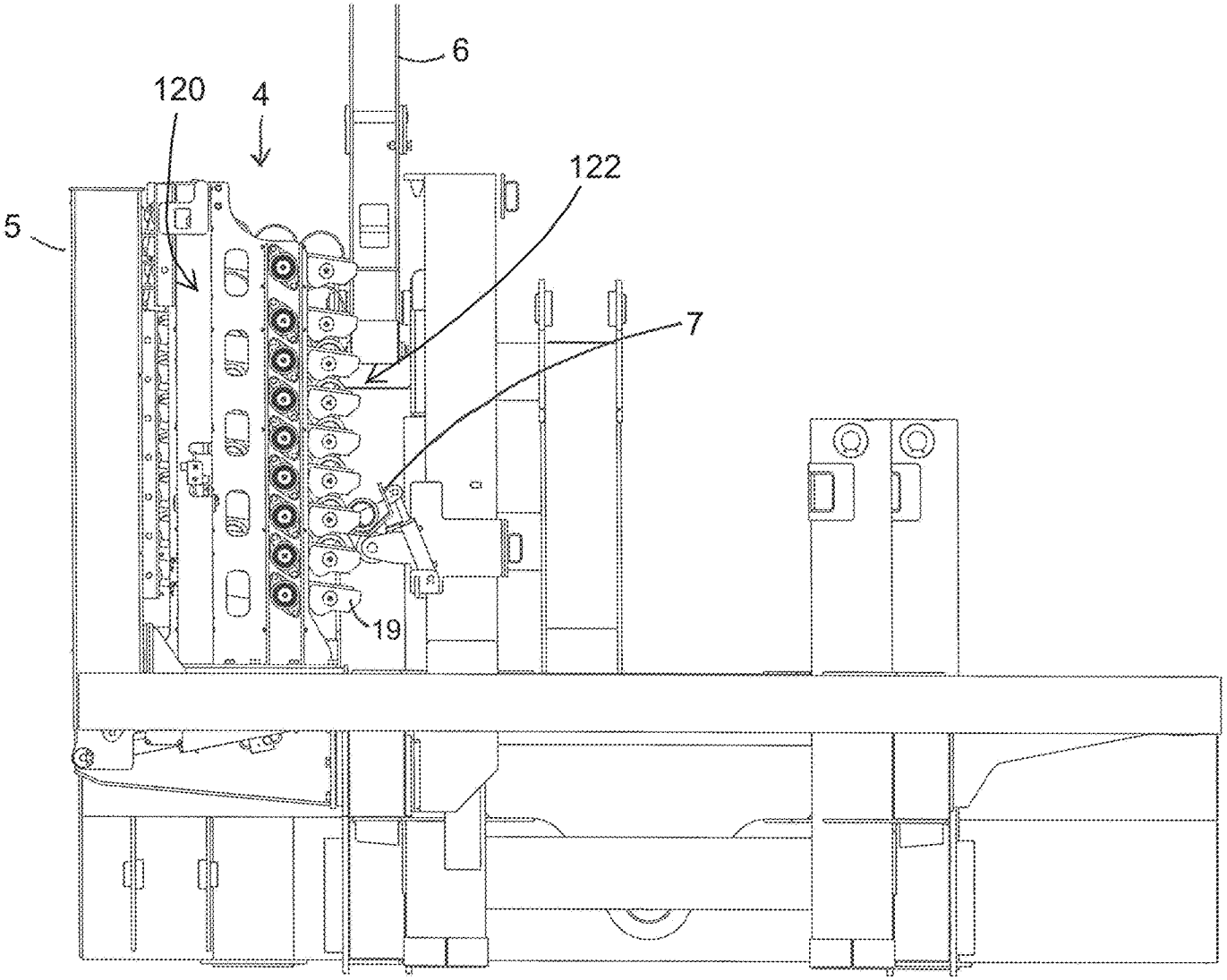
Figure 12:
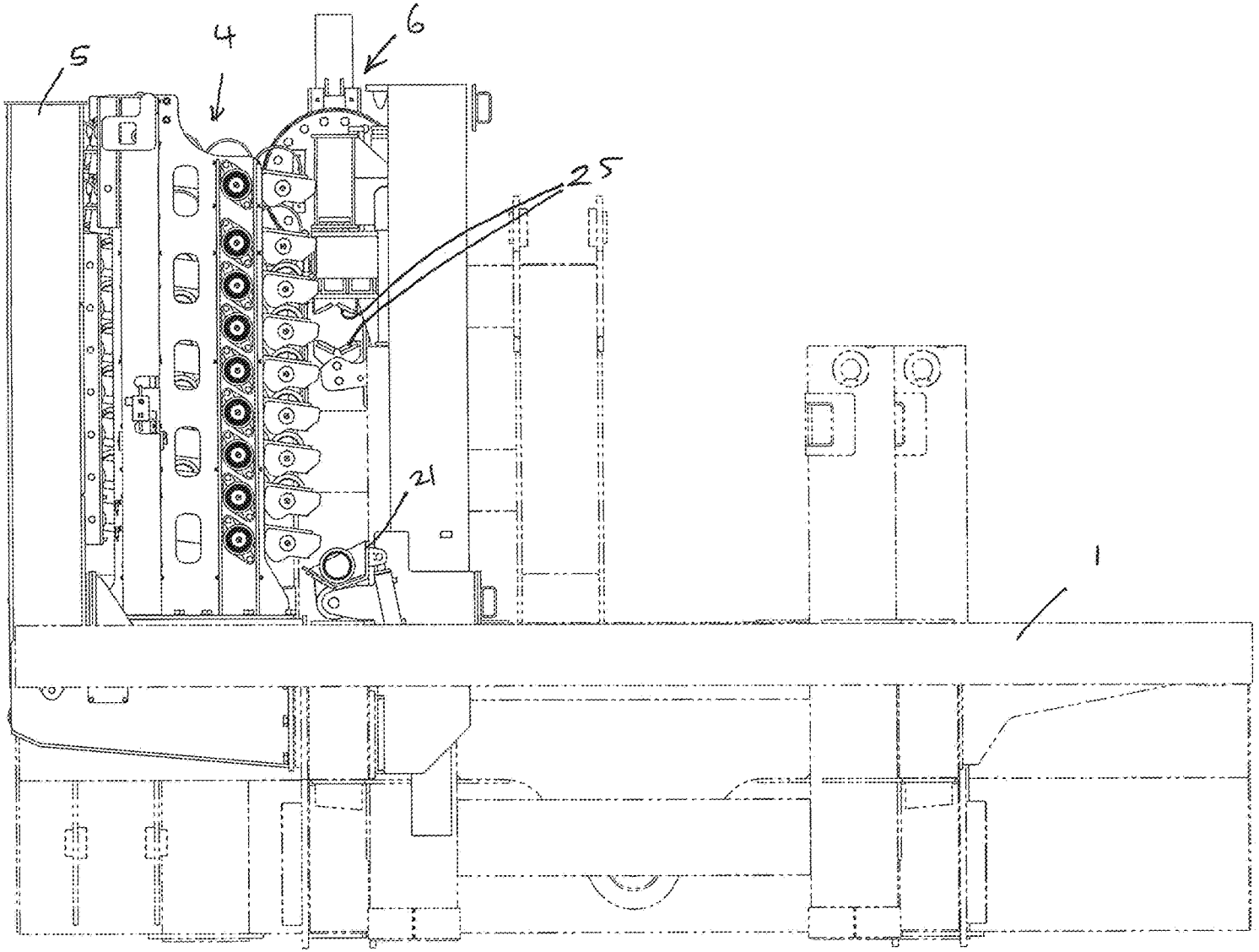
Figure 13:
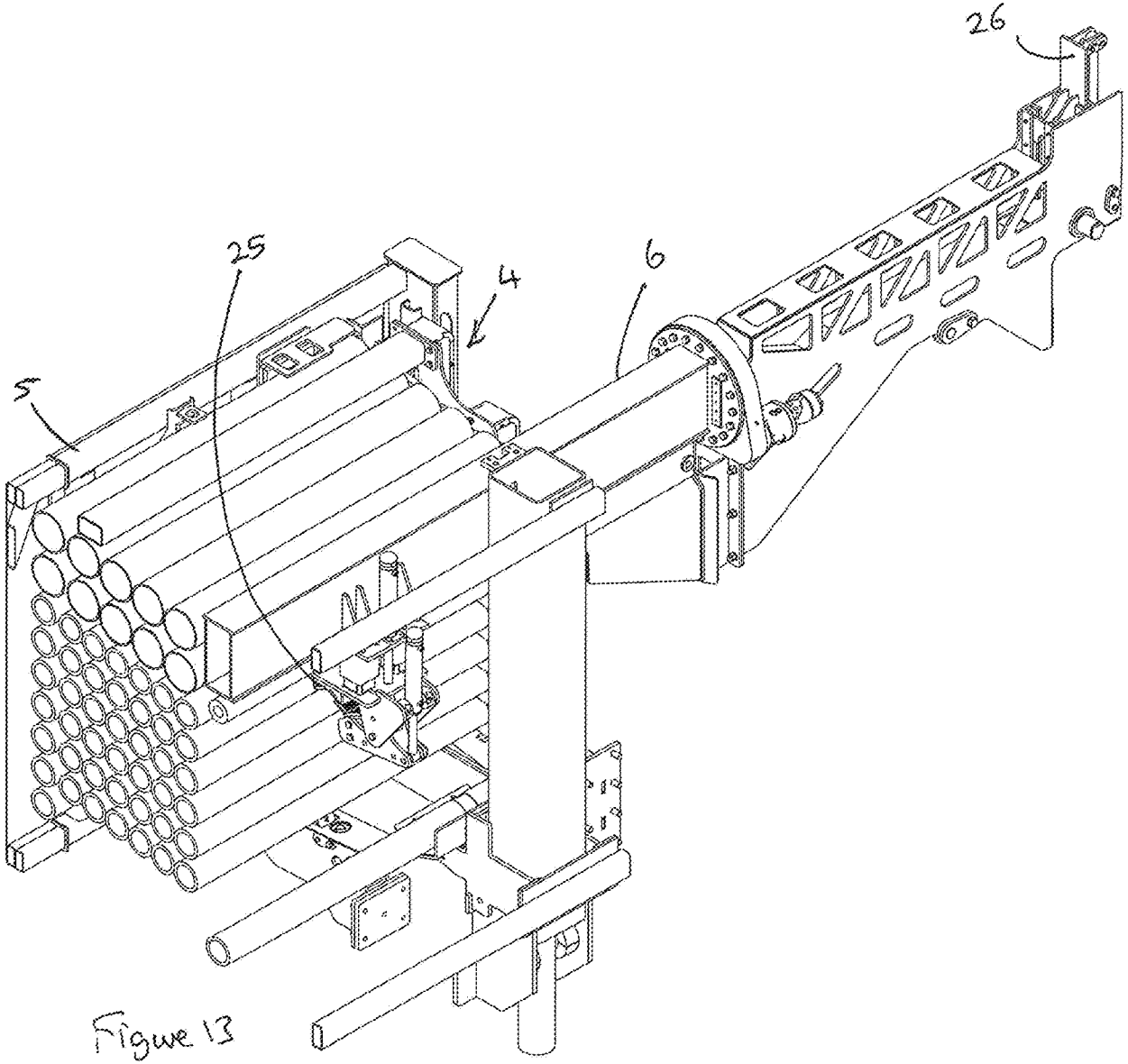

Also mounted on the chassis 1 is a rod handling system 3 having a rod storage bin 4 incorporating a plurality of vertically stacked drilling rod supports, each rod support being adapted to hold a respective row of drilling rods in side by side relationship in a substantially horizontally extending storage configuration aligned with the longitudinal axis of the chassis; a rod loader 5 having a plurality of rod holders adapted to carry a plurality of drilling rods in side by side relationship, the rod loader 5 being pivotally mounted on a side of the chassis 1 for pivotal movement about a pivot axis A between an outwardly extending horizontal loading position, as shown in FIGS. 5 and 9, with the rod holders facing upwardly, wherein a rod can be placed into or removed from each rod holder, and a vertically arranged transfer position, as shown in FIGS. 10 to 12, wherein rods are able to be transferred between each rod holder and an adjacent rod support of the rod storage bin 4; a rod lifter 6 that is pivotal about a pivot axis B for lifting rods between the substantially horizontal storage configuration and a raised use configuration (for example from 45° to 90° to the horizontal) to be aligned with and for transfer to and from the drilling mast 2; and a rod transfer assembly 7 adapted to transfer selected rods between each rod support of the rod storage bin 4 and the rod lifter 6.

The rod loader 5 is located on a first side 120 of the rod storage bin 4, the rod lifter 6 and rod transfer assembly 7 being located on a second side 122 of the rod storage bin 4, opposite the first side (FIGS. 10 and 11).

The rod loader 5 is pivotally mounted on the one side of the chassis 1 about a horizontal pivot axis parallel to the elongate axis of the chassis 1 for movement between its loading position, wherein the road loader extends substantially horizontally and cantilevered outwardly from the first side of the rod storage bin 4, and its transfer position, wherein the rod loader extends vertically adjacent the first side of the rod storage bin 4 to effectively close and protect the first side of the rod storage bin 4. Hydraulic or pneumatic rams 8 or other actuators may be provided for moving the rod loader 5 between its loading and transfer positions.

Figure 6:
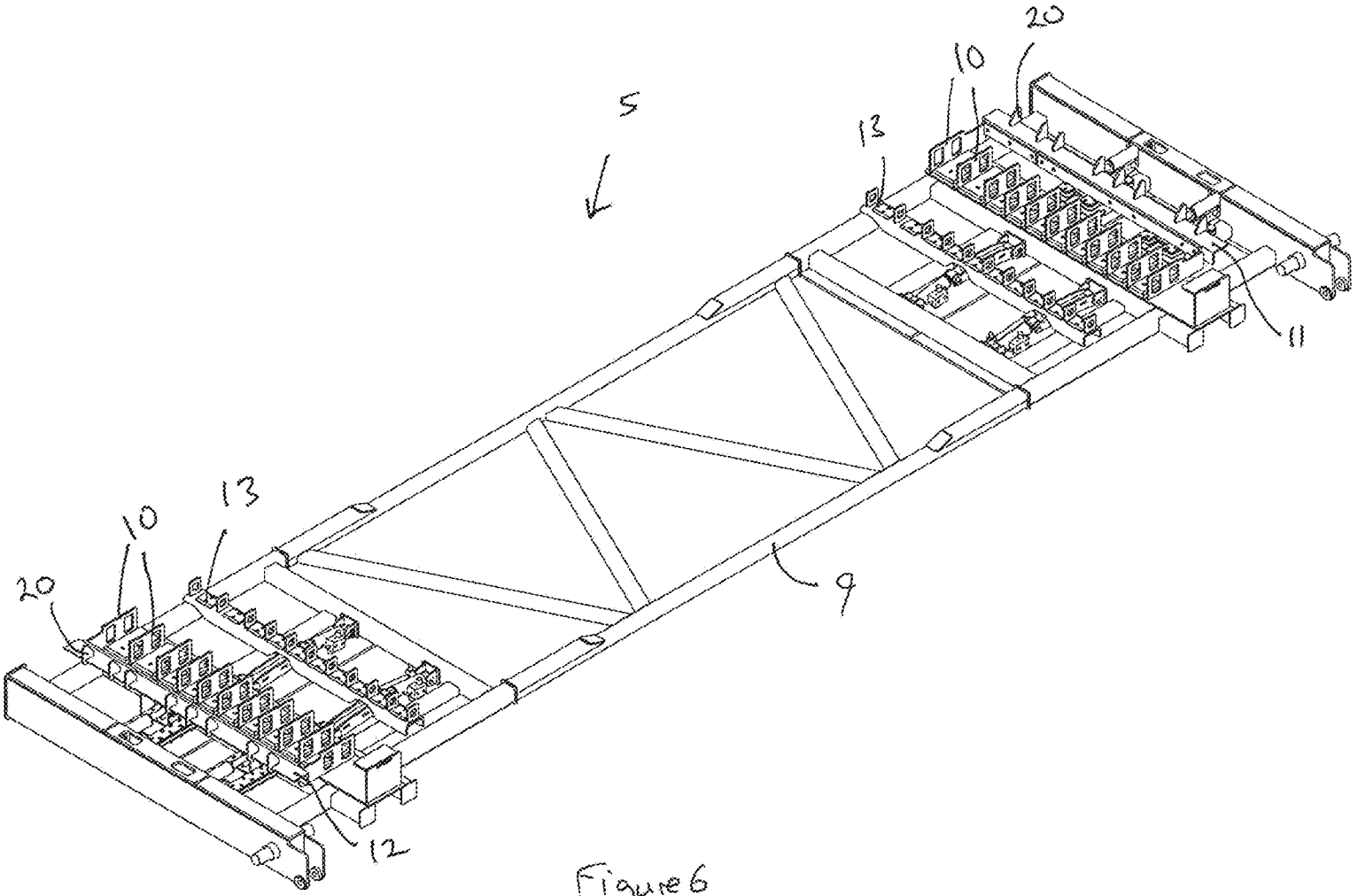
FIGS. 6 and 7 are detailed perspective views of the rod loader of the drilling rig of FIG. 1.
Figure 7:
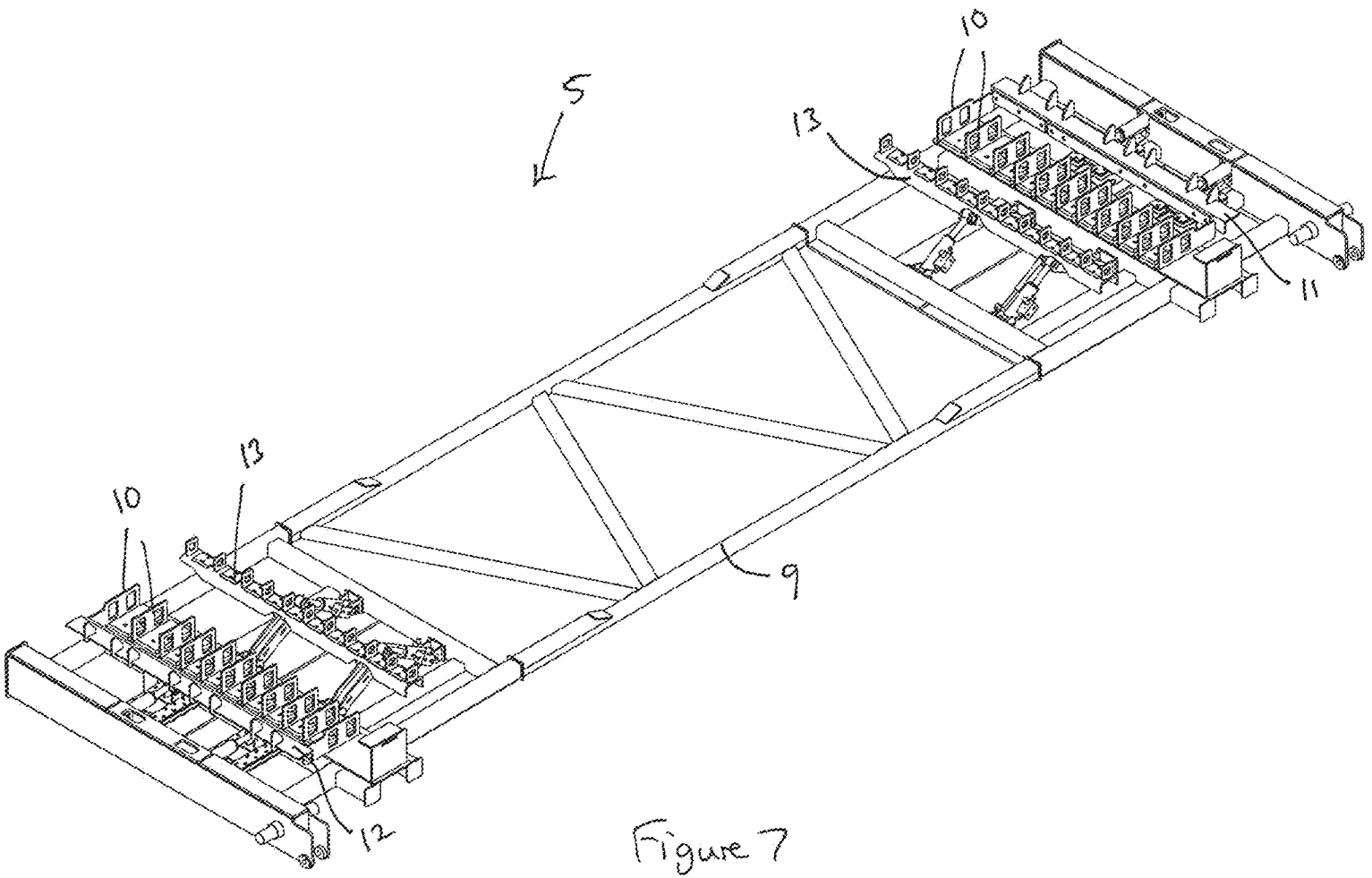

As best illustrated in FIGS. 6 and 7, the rod loader 5 includes a frame 9 upon which is mounted a plurality of spaced pairs of laterally extending divider plates 10 between which a respective rod may be located, such that the pairs of divider plates 10 delimit the rod holders of the rod loader 5. The distance between adjacent pairs of divider plates 10 may be adjustable so that the rod holders can be adapted to carry rods of different diameters. The divider plates 10 are located on an inner side of the frame 9 to extend upwardly when the rod loader 5 is in its loading position and inwardly towards the rod storage bin 4 when the rod loader 5 is in its transfer position. The positions of the divider plates 10 on the road loader may also be laterally adjustable on the frame 9 to facilitate alignment of the rod holders with the rod supports and transfer of the rods between the rod holders of the rod loader 5 and the rod supports of the rod storage bin 4. The rods are retained between the divider plates 10 defining the rod holders of the rod loader by opposing clamp bars 11, 12 provided at opposite ends of the rod loader 5 and moveable towards and away from one another between a clamping position, wherein the clamp bars 11,12 engage opposite ends of rods located in the rod holders, and a release position, wherein the clamp bars 11,12 are spaced from the ends of the rods. Hydraulic or pneumatic rams or other actuators may be provided for moving the clamp bars 11,12 towards their clamping position. The clamp bars 11,12 may be spring biased towards their release position. The clamp bars 11,12 may be provided with resilient gripping pads to engage and grip the ends of the rods.

As shown in FIG. 7, the rod loader 5 may include pushers 13 adapted to move into each rod holder when activated and when the rod loader is in its transfer position, to push a rod located therein out of the respective rod holder and into an adjacent rod support of the rod storage bin 4.

Figure 8B:
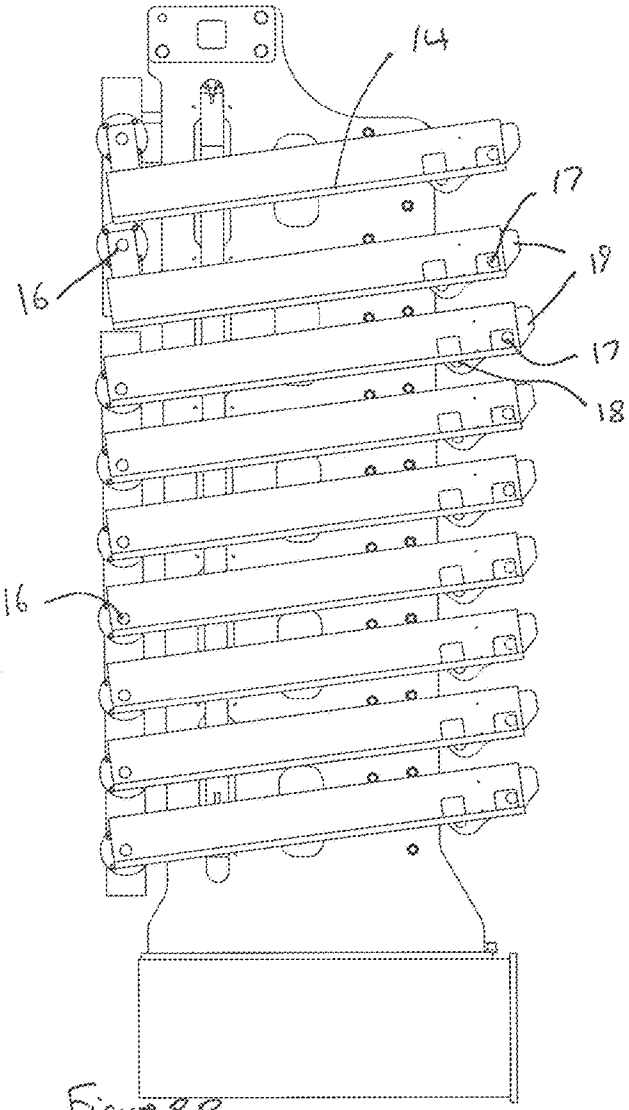
FIG. 8B is a side view of one side of the rod storage bin of the drilling rig of FIG. 1.
Figure 8A:
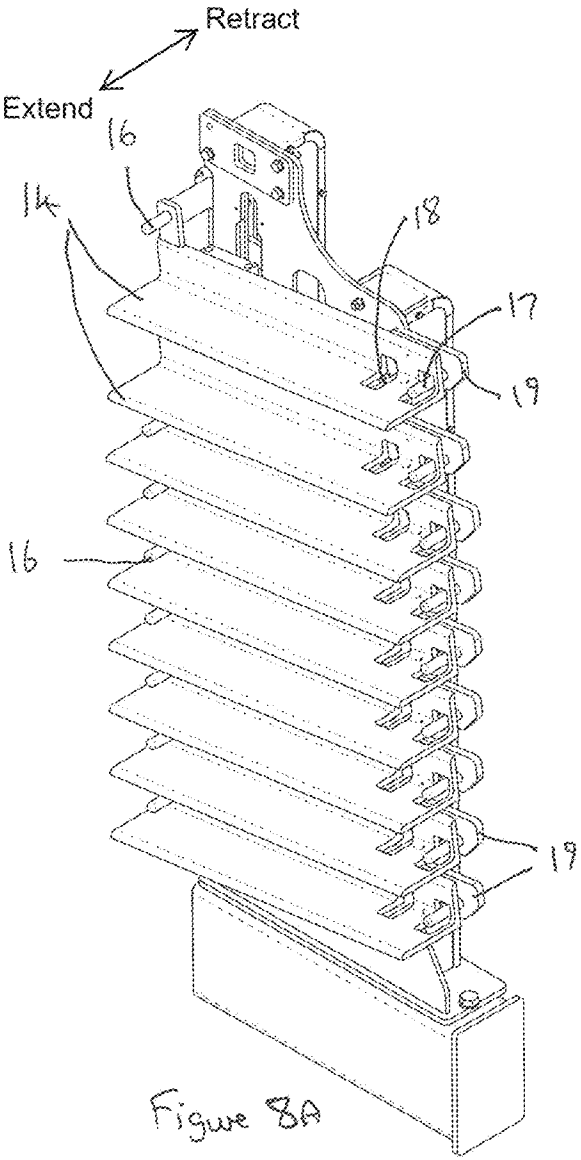
FIG. 8A is perspective view of one side of the rod storage bin of the drilling rig of FIG. 1.

As best illustrated in FIGS. 7 and 8, the rod storage bin 4 includes vertically stacked rod supports, each rod support being defined by opposing pairs of rod support members in the form of vertically spaced L shaped support plates 14,15 extending transversely to the longitudinal axis of the chassis and having lower portions extending horizontally and inwardly from opposite ends of the rod storage bin 4 and upon which respective ends of the respective rods are supported.

Each pair of support plates 14,15 of each rod support extend transverse to the elongate axis of the chassis 1 to support a plurality of rods thereon in side by side relationship in a row aligned with the elongate axis of the chassis 1 and along the length of the chassis 1.

The rods are retained in each rod support of the rod storage bin by means of retaining pins extending inwardly from each end of each rod support plate 14,15, each retaining pin being moveable between a retracted position, wherein rods are free to pass laterally into and out of the respective rod support, and an extended position, wherein retaining pins interacts with end regions of the rods in each rod support to prevent the rods from passing laterally out of the respective rod support.

Each rod support plate 14,15 of each rod support is mounted to be tilted to adjust the angle of the respective rod holder with respect to the horizontal between a first position, shown in FIGS. 8 and 9, wherein the rod support plates slope downwardly towards the rod loader, and a second position, shown in FIGS. 10 to 15, wherein the rod support plates slope downwardly towards the rod transfer assembly 7.

In the embodiment shown in the drawings, each support plate 14,15 of each rod support includes a first retaining pin 16 at one end, adjacent the rod loader 5, the first retaining pins 16 being vertically moveable between a first position, wherein the pins 16 blocks passage of a rod into and out of a respective pair of rod support plate 14,15, and a second position, wherein a rod may pass beneath the first retaining pins 6 to pass into and out of a respective pair of support plates 14,15.

Each support plate 14,15 of each rod support includes a pair of second retaining pins 17,18 at a second end of the respective support plate 14,15, opposite the first end and adjacent the rod transfer assembly 7, the second pair of retaining pins 17,18 being laterally spaced apart at the approximate spacing of the width of a rod to be held in the rod storage bin 4 to define an outer pin 17 adjacent the second end of the respective support plate 14,15 and an inner pin 18 spaced inwardly from the outer pin 17, each pair of second pins 17,18 being mounted on a common pivot plate 19 arranged such that when the pivot plate 19 is in a first position, the outer pin 17 enters into the path of rods on the respective support plate 14,15 to prevent rods from passing between the respective pair of support plates and the rod transfer assembly 7, with the inner pin 18 of the respective pivot plate 19 out of the path of the rods, and a second position, wherein the inner pin 18 enters into the path of rods on the respective support plate 14,15 and the outer pin 17 moves out of the path of the rods on the respective support plate 14, 15 to allow an outermost rod held in the respective pair of opposing support plates 14,15 to move between the rod storage bin 4 and the rod transfer assembly 7, as will be described below in more detail.

The retaining pins 16,17,18 thereby serve as gates at end of each rod support plate 14,15.

The first retaining pins 16 of each vertical stack of rod supports of the rod storage bin may be moved between their first and second positions by a common actuating mechanism. Such actuating mechanism may interact with the rod loader 5 such that the first retaining pins 16 are moved from their first to their second positions as the rod loader 5 moves to its transfer position. The first retaining pins 16 may be biased towards their first position by suitable biasing means or member, such as a spring.

The pivot plate 19 of each second pair of retaining pins 17,18 of each support plate 14,15 may be urged to its second position by interaction with the rod loader 7 as it moves to its transfer position and may be biased to its first position by means of a respective spring. Alternatively one or both of the retaining pins 17,18 may be operated independently via an actuator, such as a hydraulic actuator or solenoid.

For example, as shown in FIGS. 9 to 11, as the rod loader 5 moves to its transfer position, laterally extending actuating plates or projections 20 extending from the rod loader 5 may engage an actuator of the first retaining pins 16 on the first side of the rod storage bin 4 to urge the first retaining pins 16 to their second positions against a biasing means as in a spring, such as a torsion spring, biasing the respective first retaining pins 16 to their first positions.

The rod transfer assembly 7 includes a spaced apart pair of rod transfer members having tiltable V shaped upwardly facing support members in the form of rod cradles 21 for supporting a rod thereon, the cradles 21 being vertically moveable with respect to the rod storage bin to be brought into alignment with each of the rod supports of the rod storage bin 4, as required, and being tiltable between a rod holding position, wherein a rod can be supported thereon, and at least one tilted rod transfer position, whereby a side portion of each cradle 21 is substantially aligned with the adjacent rod support plate 14,15 when in its transfer position such that a rod can be laterally displaced between the rod cradles 21 of the rod transfer assembly 7 and a respective rod support of the rod storage bin 4.

The rod cradles 21 may be mounted adjacent the rod support plates 14, 15 of the rod storage bin 4 and mounted on a lift mechanism, such as a chain and sprocket assembly or a linear actuator/ram, to allow the rod cradles 21 to be moved up and down with respect to the rod support bin 4 to be brought into alignment with respective rod supports.

As discussed above, the rod cradles 21 may be adapted to interact with the pivot plates 19 of the second pair retaining pins 17,18 of respective pairs of rod support plates 14,15 to tilt the adjacent pivot plates 19 to their second positions as the rod cradles 21 are moved to their transfer position adjacent the respective pair of rod support plates 14,15.

The rod cradles 21 of the rod transfer assembly 7 are adapted to move in the vertical plane of the rod lifter 6 to move selected rods between selected a selected rod support and the rod lifter.

The rod lifter 6 may be provided with rod clamps 25 to clamp a pipe against a side of the rod lifter 6 and present the rod to the drilling mast 2, as the rod lifter 6 is moved to its vertical position. The rod clamps 25 may be adapted to displace a rod clamped therein axially with respect to the rod lifter 6 to bring a rod into the correct position on the drilling mast 2 when the rod lifter 6 is moved to its raised position.

The rod lifter 6 is rotatable about its longitudinal axis such that the rod clamps 25, mounted on one side of the rod lifter, are moved between a first position on a lower side of the rod lifter 6, to allow rods to be transferred between the rod cradles 21 and the clamps 25 of the rod lifter 6, and a second position on an opposite or upper side of the rod lifter 6 to allow the rods to be presented to the drilling mast 2, as illustrated in FIGS. 17 to 20.

During operation of the rod lifter 6 to present a rod to the drilling mast 2, the rod transfer assembly 7 may simultaneously bring the next required rod from the rod storage bin 4 into position to be moved to the rod lifter 6 when it returns to its lowered position.

A control system or controller C (FIGS. 1 and 2) is provided for controlling the operation of the rod handling system in a semi or fully automated matter requiring little or no user interaction, allowing the drilling rig to be operated autonomously or remotely. The control system may be programmed to operate the various parts of the rod handling system in a predetermined sequence to control the transfer of rods between the rod loader and the rod storage bin and between the rod storage bin and the rod lifter.

In use, firstly the rod loader 5 may be operated to fill the rod storage bin 4 with the required drilling rods, the rod loader 5 being lowered to its loading position, the spacing and positions of the divider plates 10 being adjusted to suit the size of rods to be loaded, and rods may be loaded into the rod holders of the rod loader 5 and clamped in place by moving the clamp bars 11,12 to their clamping position. The rod loader 5 is then raised to its transfer position, wherein the actuating plates 20 engage the first retaining pins 16 of the rod support plates 14,15 of the rod storage bin 4. The actuating plates 20 of the rod loader 5 interact with the first retaining pins 16 to move them to their second position to allow rods to move between the rod loader 5 and the rod supports of the rod storage bin 4 once the clamp bars 11,12 are retracted. The positions of the divider plates 10 of the rod loader 5 may be further adjusted to bring the rods to the correct height for transfer into the rod supports of the rod storage bin 4. If necessary, the angle of the support plates 14,15 of the rod storage bin 4 may be adjusted to a rod loading position, for example tilted at an angle of approximately 8° downwardly away from the rod loader 5. The pushers 13 are extended to simultaneously push the row of rods from the rod holders of the rod loader 5 into the respective rod supports of the rod storage bin 4. This process is repeated until the rod storage bin 4 is full.

The drilling rig may then move to a drilling location, such as via remote control.

Once a drilling location is reached the drilling mast 2 may be moved to its raised position, along with the rod lifter 6, and the rod transfer assembly 7 may be operated to select a rod from the rod storage bin 4, transfer such rod into the rod cradles 21 and then transfer the selected rod into the rod clamp 25 of the rod lifter 21.

The lifting mechanism of the rod transfer assembly is operated to move the rod cradles 21 into vertical alignment with the selected rod support of the rod storage bin 4 and tilted it its transfer position in alignment with the respective support plates 14,15 of the selected rod support, at the same time acting upon the pivot plates 19 of the adjacent pair of second retaining pins 17,18 to move the outer pins 17 out of the path of the rods, allowing a rod adjacent to the rod cradles 21 to roll into the cradles 21. At the same time the inner retaining pins 18 are moved into the path of the rods to retain the remaining rods in the selected rod support in place.

The rod cradles 21 are raised in the vertical plane of the rod lifter 6 until the rod engages the rod clamps 25 of the rod lifter 6 which are then operated to grip the rod. The rod lifter 6 may then be raised and rotated to present the rod to the drilling mast.

Figure 18:
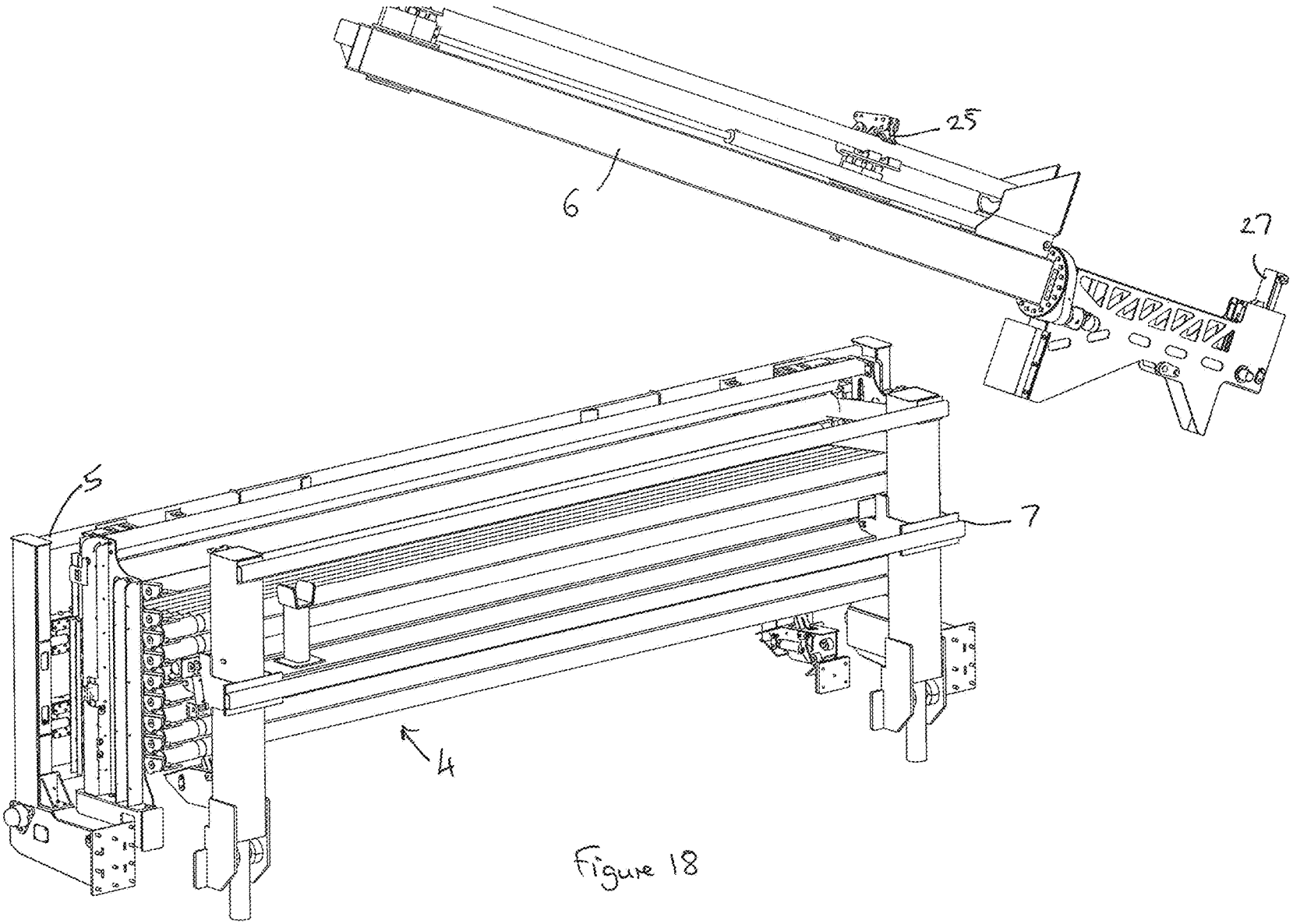
Figure 19:
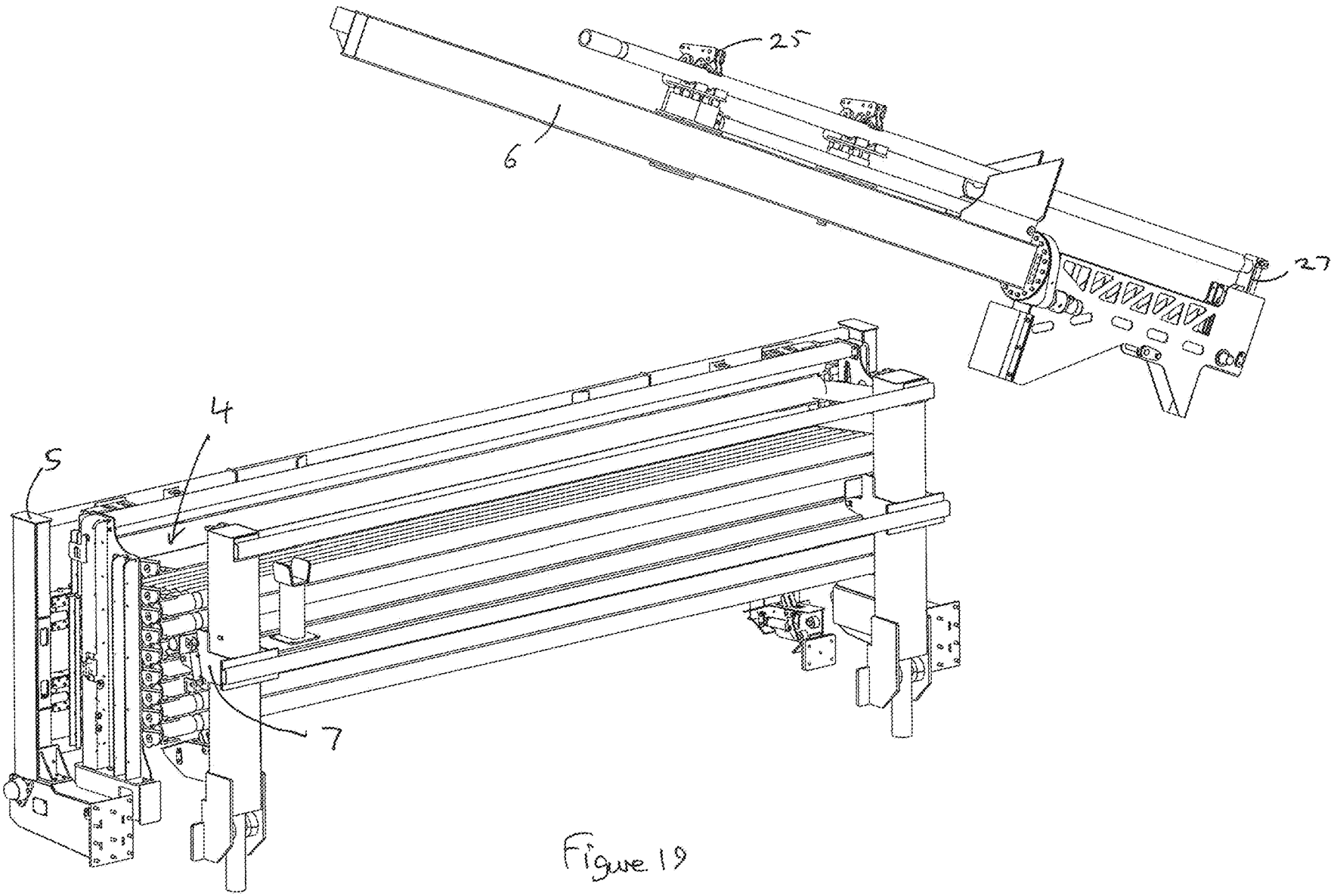
Figure 20:
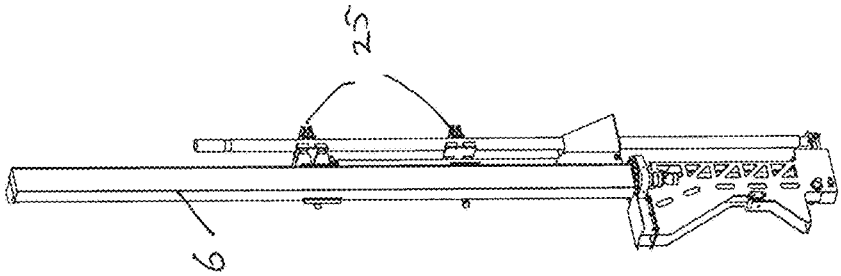
Figure 20:
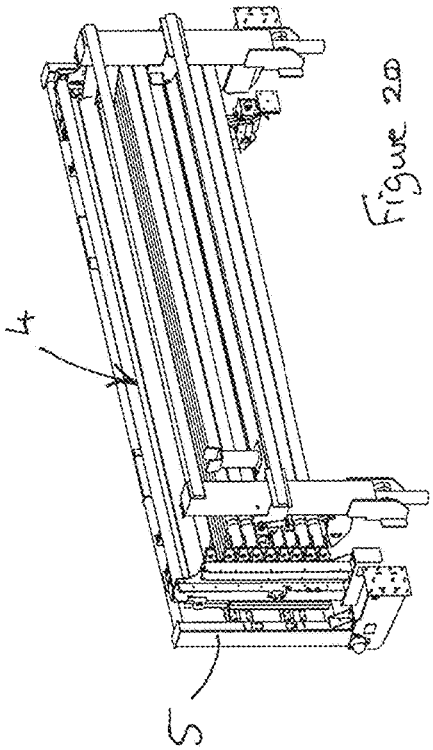

As shown in FIGS. 18 and 19, the rod clamps 25 may be moved along the rod lifter 6 to axially move the rod into the required position for presenting to the drilling mast 2, for example against a stop 26 on the rod lifter 6, and the rod lifter 6 is raised into alignment with the drilling mast 2 so that the rod may be coupled to the drill string.

Meanwhile, the rod cradles 21 of the transfer assembly 7 may be operated to interact with the rod storage bin to bring the next rod into position to be transferred to the rod lifter 6 when it is returned to its lowered position.

The above described sequence may be reversed to remove rods from the drill string and return them to the rod storage bin 4.

Figure 14:
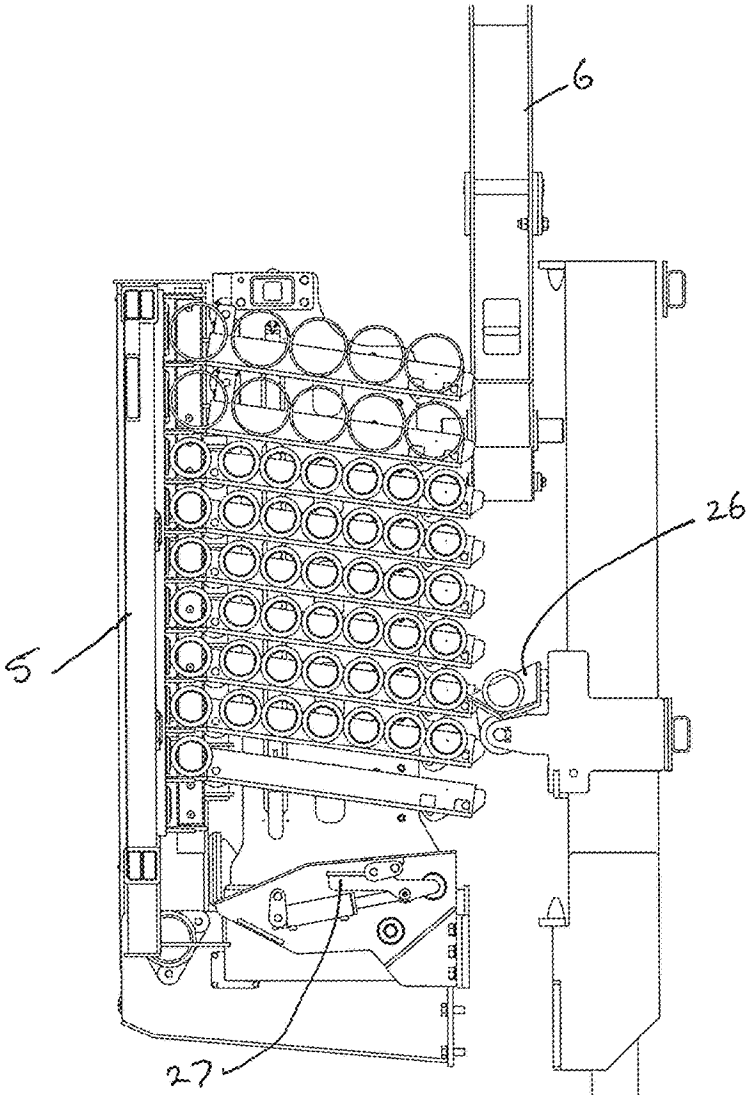
Figure 15:
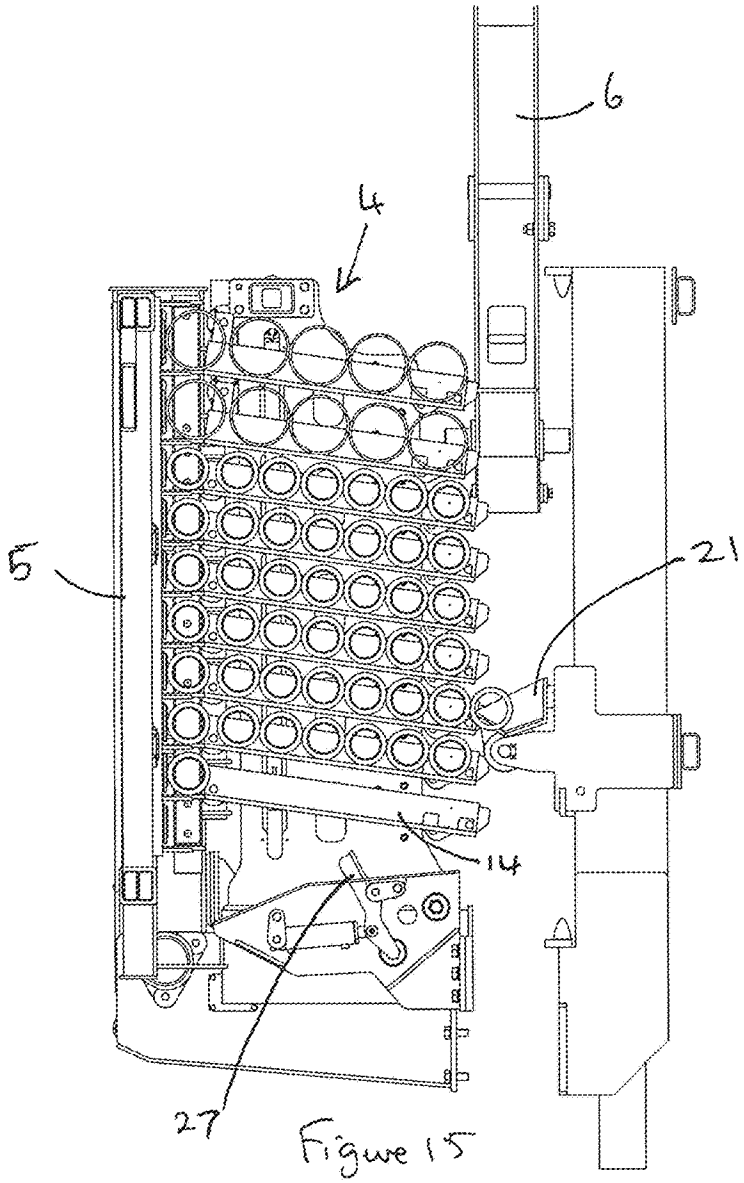
Figure 16:
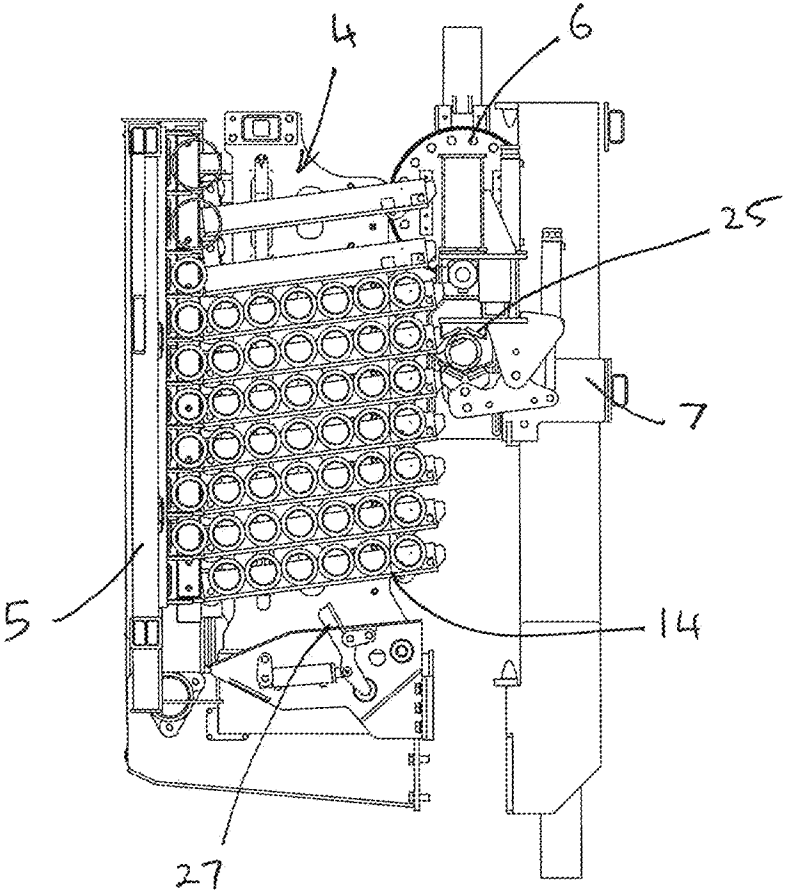
Figure 17:
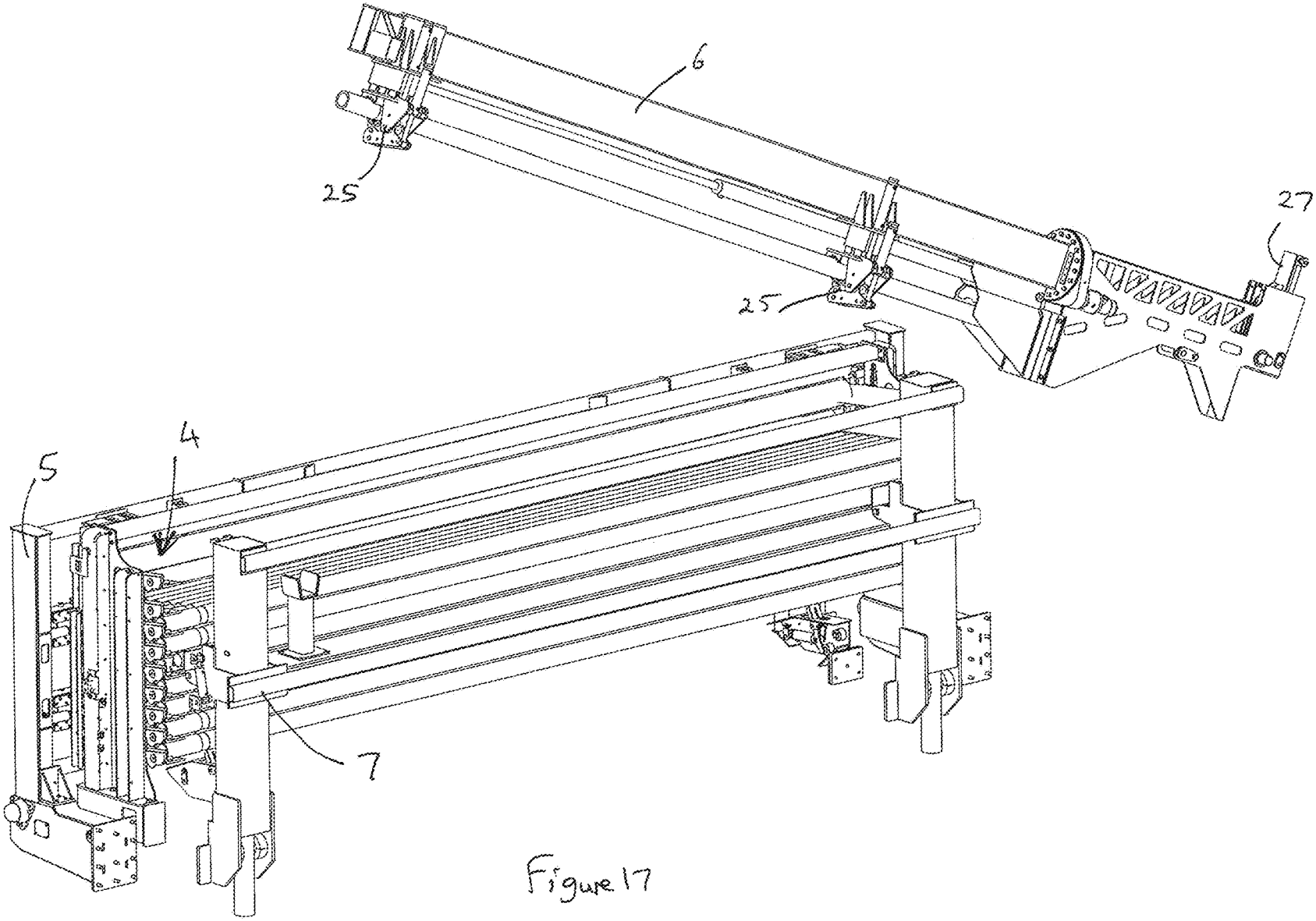
FIGS. 17 to 20 illustrate operation of the rod lifter of the rod handling system of the drilling rig of FIG. 1.

The rod cradles 21 may be adapted to move to a lowermost position to unload rejected rods to a rejection position, beneath the rod supports of the rod storage bin 4, as illustrated in FIGS. 14 and 15. This may take place should a rod selected from the rod storage bin 4 be determined to be an incorrect size or type. A moveable stop 27 may be provided to retain a rod in the rejection position prior to release, when the rejected rod may pass out of the rejection position and into a lowermost rod holder of the rod loader 5.

The invention is not limited to the embodiment described herein but can be amended or modified without departing from the scope of the present invention, as defined by the appended claims which is intended to be limited only by the scope of the appended claims as interpreted according to the principles of patent law including the doctrine of equivalents.

The invention claimed is:

1. A rod handling system for a drilling rig, said rod handling system comprising:

a rod storage bin having an elongate axis and incorporating a plurality of vertically stacked rod supports, each of said rod supports being adapted to hold a respective row of rods in side by side relationship in a substantially horizontally extending storage configuration in which the rods are aligned with said elongate axis;

a rod loader having a plurality of rod holders adapted to carry a plurality of rods in side by side relationship aligned with said elongate axis, said rod loader being moveable between a loading position, wherein in which a rod can be placed into or removed from each rod holder, and a transfer position in which the rods are transferable between each of said rod holders and a respective rod support of said rod storage bin;

a rod lifter moveable between a lowered position and a raised position whereby said rod lifter is adapted to lift the rods between said substantially horizontally extending storage configuration and a raised configuration to present the rods to a drilling head; and a rod transfer assembly adapted to transfer individual ones of the rods between selected ones of said rod supports of said rod storage bin and said rod lifter.

2. The system of claim 1, wherein said rod loader is located on a first side of said rod storage bin, said rod lifter and said rod transfer assembly being located on a second side of said rod storage bin, opposite said first side.

3. The system of claim 2, wherein said rod loader is mounted for pivotal movement about a horizontal pivot axis parallel to said elongate axis for movement between said loading position in which said rod loader extends outwardly from said first side of said rod storage bin with said rod holders facing upwardly to allow the rods to be place therein, and said transfer position in which said rod loader extends vertically adjacent said first side of said rod storage bin.

4. The system of claim 3, wherein said rod loader closes said first side of said rod storage bin when in its transfer position.

5. The system of claim 2, wherein said rod lifter is pivotally mounted for movement between said lowered and raised positions about a pivot axis extending perpendicular to said elongate axis and located at one end of said rod storage bin, such that said rod lifter moves in an arc through a vertical plane.

6. The system of claim 5, wherein said rod transfer assembly comprises at least one rod carrier for carrying a selected one of the rods, said at least one rod carrier being vertically moveable with respect to said rod storage bin.

7. The system of claim 6, wherein said at least one rod carrier moves in said vertical plane of said rod lifter.

8. The system of claim 7, wherein said at least one rod carrier comprises a pair of rod cradles being vertically moveable with respect to said rod storage bin to facilitate transfer of the rods between a selected rod support and said rod transfer assembly.

9. The system of claim 8, wherein said rod cradles comprise tiltable V shaped upwardly facing support members moveable between an upright rod holding position and at least one tilted rod transfer position, wherein said rod cradles are adapted to transfer the rods between said rod lifter and selected rod supports of said rod storage bin, when said rod lifter is in its lowered position.

10. The system of claim 1, wherein each rod holder of said rod loader is defined by one or more spaced pairs of laterally extending divider plates between which a respective rod may be located.

11. The system of claim 10, wherein the distance between adjacent pairs of divider plates is adjustable so that said rod holders can carry rods of different diameters.

12. The system of claim 1, wherein the rods are retained in said rod holders of said rod loader by opposing clamp bars provided at opposite ends of said rod loader and moveable towards and away from one another between a clamping position in which said clamp bars engage opposite ends of the rods located in said rod holders, and a release position in which said clamp bars are spaced from the ends of the rods.

13. The system of claim 12, wherein said clamp bars are pivotally or linearly moveable between said clamping and release positions.

14. The system of claim 1, wherein said rod loader includes pushers adapted to move into each rod holder, when activated and when said rod loader is in its transfer position, to push a rod located therein out of said rod holders and into adjacent ones of said rod supports of said rod storage bin.

15. The system of claim 1, wherein each of said rod supports of said rod storage bin comprises a pair of support members extending inwardly from opposite ends of said rod storage bin and upon which respective ends of the rods are supported.

16. The system of claim 15, wherein each said pair of support members extend transverse to said elongate axis to support a plurality of the rods thereon in side by side relationship in a row.

17. The system of claim 16, wherein the rods are retained on said support members of each of said rod supports of said rod storage bin by means of retaining pins provided at each end of each said rod support on or adjacent each support member, each said retaining pin being moveable between a retracted position in which the rods are free to pass laterally into and out of a respective one of said rod supports, and an extended position in which said retaining pins interact with end regions of the rods in each said rod support to prevent the rods from passing laterally out of said respective rod support.

18. The system of claim 17, wherein one or more of said retaining pins is moveable between said retracted and extended positions axially and in a direction parallel to said elongate axis and/or pivotally between said retracted and extended positions.

19. The system of claim 18, wherein at least one of said retaining pins at each end of each rod support is adapted to enter into a path of a respective rod supported therein, at or adjacent one end of each said support member.

20. The system of claim 18, wherein at least one of said retaining pins at each end of each said rod support is adapted to enter into a respective end of a respective rod supported therein, at or adjacent a central region of each said support member.

21. The system of claim 15, wherein each said support member of said rod supports comprises an L shaped plate extending substantially horizontally and transverse to said elongate axis and inwardly from a respective end of said rod storage bin.

22. The system of claim 15, wherein each pair of support members of each rod support is inclined to the horizontal to roll the rods supported thereon to one side or another of said rod storage bin under gravity.

23. The system of claim 1, wherein rod clamps are associated with said rod lifter to clamp one of the rods against said rod supports such that the rod can be retained on said rod lifter as it said rod lifter moves to its raised position.

24. The system of claim 1, further in combination with and mounted on a self-propelled mobile chassis.

25. The system and chassis of claim 24, wherein said chassis is supported on tracks and includes a drive for driving said tracks.

26. The system of claim 1, wherein the system is adapted to be remotely and/or autonomously controlled.

27. The system of claim 1, further comprising a controller programmed to at least semi-autonomously control the operation of said system.

28. A drilling rig-having comprising:

a chassis;

a drilling mast moveable between a raised position and a lowered position; and a rod handling system comprising:

a rod storage bin having an elongate axis and incorporating a plurality of vertically stacked rod supports, each rod support being adapted to hold a respective row of rods in side by side relationship in a substantially horizontally extending storage configuration in which the rods are aligned with said elongate axis;

a rod loader having a plurality of rod holders adapted to carry a plurality of the rods in side by side relationship aligned with said elongate axis, said rod loader being moveable between a loading position in which one of the rods can be placed into or removed from each rod holder, and a transfer position in which the rods are transferable between each rod holder and a respective rod support of said rod storage bin;

a rod lifter moveable between a lowered position and a raised position whereby said rod lifter is adapted to lift the rods between said substantially horizontally extending storage configuration and a raised configuration to present the rods to a drilling head; and a rod transfer assembly adapted to transfer individual ones of the rods between selected rod supports of said rod storage bin and said rod lifter.

* * * * *